US006880457B2

(12) United States Patent
Roesch et al.

(10) Patent No.: US 6,880,457 B2
(45) Date of Patent: Apr. 19, 2005

(54) PROCESS AND DEVICE FOR PRINTING A MULTICOLOR IMAGE

(75) Inventors: Kurt Roesch, Villars-sur-Glâne (CH); Urs Tschudi, Düdingen (CH)

(73) Assignee: Polytype S.A., Fribourg (CH)

( * ) Notice: Subject to any disclaimer, the term of this patent is extended or adjusted under 35 U.S.C. 154(b) by 0 days.

(21) Appl. No.: 10/481,482

(22) PCT Filed: Jun. 5, 2003

(86) PCT No.: PCT/CH03/00360

§ 371 (c)(1),
(2), (4) Date: Dec. 17, 2003

(87) PCT Pub. No.: WO03/103966

PCT Pub. Date: Dec. 18, 2003

(65) Prior Publication Data

US 2004/0173110 A1 Sep. 9, 2004

(30) Foreign Application Priority Data

Jun. 6, 2002 (DE) ..... 102 25 198

(51) Int. Cl.[7] ..... B41F 17/08

(52) U.S. Cl. ..... 101/38.1; 101/36; 101/485; 101/487

(58) Field of Search ..... 101/35, 37, 38.1, 101/40.1, 485, 487

(56) References Cited

U.S. PATENT DOCUMENTS 4,519,310 A * 5/1985 Shimizu et al. ..... 101/35
5,010,814 A * 4/1991 Shishikura ..... 101/211
5,311,816 A * 5/1994 Schliessmann ..... 101/488

FOREIGN PATENT DOCUMENTS

| | | |
|---|---|---|
| DE | 198 07 924 | 8/1998 |
| DE | 101 08 753 US | 9/2002 |
| JP | 5-96704 | 4/1993 |
| JP | 6-40007 | 2/1994 |

* cited by examiner

*Primary Examiner*—Andrew H. Hirshfeld
*Assistant Examiner*—Jill E. Culler
(74) *Attorney, Agent, or Firm*—McGlew and Tuttle, P.C.

(57) ABSTRACT

The present invention pertains to a process and to a device for printing a multicolor image composed of at least two varicolored partial images on a surface. A first partial image is transferred onto the surface in an ink transfer position and at least a second partial image is transferred onto the surface in the same ink transfer position and is superimposed to the first partial image. The partial images transferred onto the surface are dried at least partially or hardened at least partially between the ink transfer steps. The drying step is carried out according to the present invention in the ink transfer position.

Figure 1:
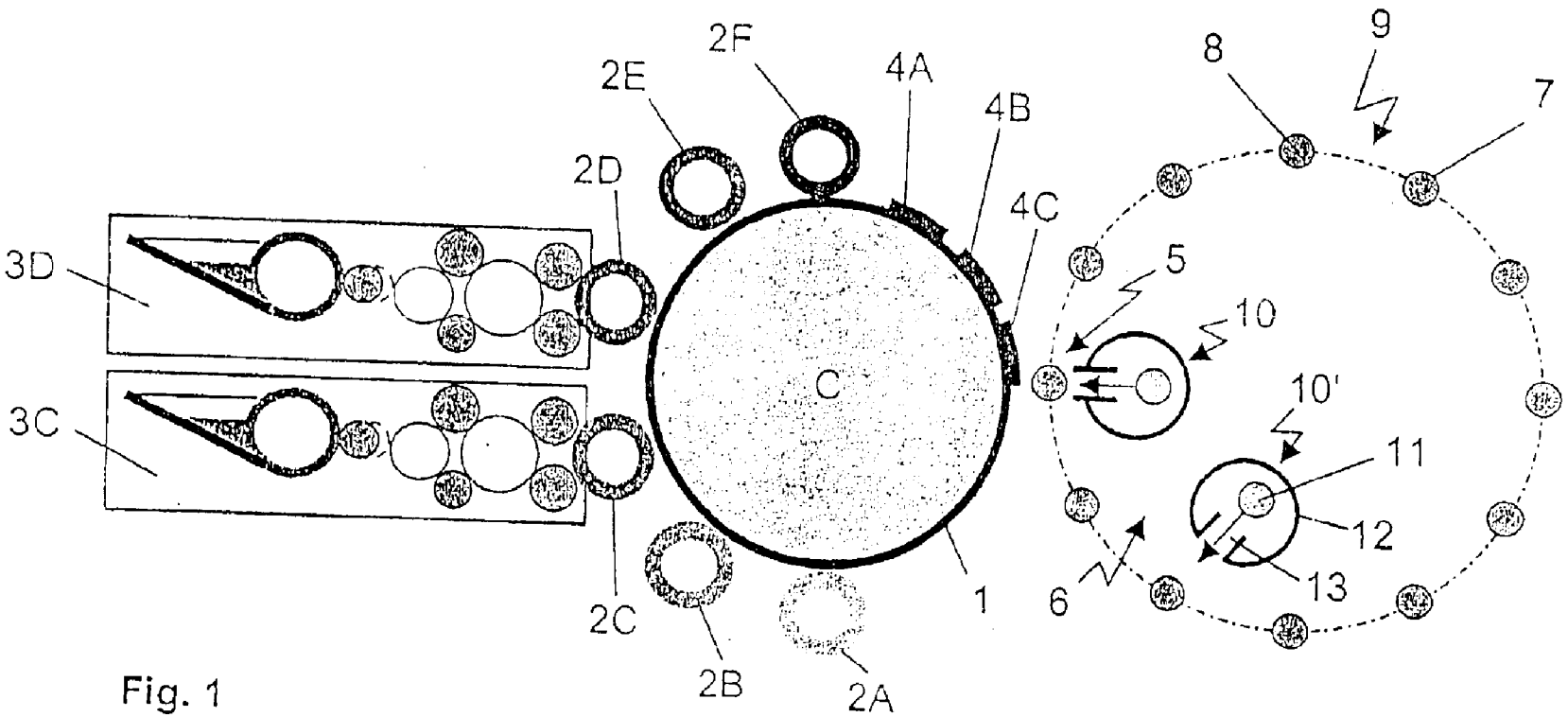

High print quality can be achieved according to the present invention in a simple manner because the first partial image set and dried partially or also the respective additional, partially dried partial images always have well-defined surface properties. Essentially cylindrical bodies are preferably printed in multiple colors according to the present invention.

24 Claims, 3 Drawing Sheets

PROCESS AND DEVICE FOR PRINTING A MULTICOLOR IMAGE

The present invention pertains to a process and a device for printing a multicolor image, especially a multicolor image composed of at least two different partial images, on a surface. An especially preferred application pertains to the printing of a multicolor image, e.g., a machine-readable bar code, on cylindrical, conical or comparably shaped containers, e.g., tubes, cans, glasses or the like.

Multicolor printing presses of model RDA12-100 and BDM916 of this class for providing cylindrical, conical or comparably shaped containers with multicolor images by means of an indirect high-pressure process, are known to the applicant. A rubber blanket cylinder is moved past printing plate cylinders and it takes over various partial images according to the wet-in-wet method and in good register, so that a total image composed of a plurality of partial images is formed on the rubber blanket. This total image is transferred to a surface to be printed on, for which purpose the container to be printed on rolls on a support mandrel in a rolling operation at the rubber blanket cylinder. To transfer the wet color image to the container, a certain pressing pressure of the rubber blanket is necessary, which leads to squeezing of the wet color image or to the enlargement of the dot in the printing gap by up to 40% and thus may lead to an impairment of the print quality.

Since only part of the print is transferred to the container during the transfer of the image and another part remains on the rubber blanket, which is moved past the plate cylinders for reinking, a certain amount of printing ink is returned in the overlapping area of varicolored partial images into the strand of rollers, which is intended for another printing ink.

The so-called ink setting, in which one or more partial images (of a different color) are set on the rubber blanket cylinder offset by the circumference of the container or by a multiple of the circumference and are thus transferred sequentially to the container, especially by rolling, is known from the state of the art to minimize this ink return. Residual ink remaining on the rubber blanket after the image transfer therefore comes into contact with the plate cylinder of the particular ink only, so that no ink return into a strand of rollers intended for another printing ink occurs.

Since the wet partial image transferred onto the container is partially transferred from the container back onto the rubber blanket during a subsequent ink transfer operation, a certain return of the ink set from the container back to the rubber blanket will occur as well.

The multicolor image transferred to the container is not dried in the ink transfer position itself in the aforementioned printing presses, but only in a drying position arranged downstream of the ink transfer position, e.g., by UV irradiation or thermal drying.

A multicolor printing device that uses the ink setting technique is known from DE 198 07 924 A1. Containers held on support mandrels in a rotary revolver are moved sequentially past printing stations, where a partial image of an individual ink each is transferred. The partial images are transferred in different ink transfer positions. The partial image transferred onto the container is dried during the transfer to a next ink transfer position. The multicolor printing device has a comparatively complicated design and requires a lot of maintenance. In particularly, a comparatively large number of components, e.g., rubber blanket cylinders and drying devices, are necessary, and a complicated moving mechanism is needed to move the containers past the printing stations such that the partial images will be superimposed to form a total image in good register. The drying is performed in this multicolor printing device between two different ink transfer positions rather than in the ink transfer position.

Japanese Patent JP 05-096704 A discloses a multicolor printing device in which a plurality of printing stations are arranged sequentially along the outer circumference of a rotary revolver, which accommodates the cylindrical containers to be printed on. A drying device, which is arranged at the corresponding ink transfer position, is associated with each printing station in this printing device. By rolling the containers past a corresponding rubber blanket cylinder, a partial image is transferred to the container. The partial image just transferred is dried on the side of a support mandrel facing away from the ink transfer position. The rotary revolver is subsequently moved on to a next ink transfer position. This multicolor printing device also has a comparatively complicated device and requires a lot of maintenance. The moving mechanism necessary for superimposing partial images in good register for the containers to be printed on is comparatively complicated.

The object of the present invention is to improve the state of the art forming this class, which was obviously used before, such as to make it possible to achieve high print quality with a simple and reliable printing process, especially in the case of printing on cylindrical or comparably shaped containers.

This object is accomplished by a process with the features according to claim 1 as well as by a process with the features according to claim 9. Advantageous variants are the subject of the subclaims that are referred back [to the principal claims].

In a process according to the present invention for printing a multicolor image, which is composed of at least two partial images of different colors, on a surface, at least a first partial image is transferred in an ink transfer position to the surface, and at least a second partial image is transferred to the surface in the same ink transfer position and is superimposed to the first partial image, and the partial images transferred to the surface are dried at least partially or are hardened at least partially in a drying step, the drying or hardening step being carried out with the printed surface in the ink transfer position. It is advantageous that the process and the method according to the present invention are comparably simple and not complicated, because the transfer of partial images takes place in the same ink transfer position. No expensive and complicated moving mechanism is therefore necessary to move the surface to be illustrated past the ink transfer position. Because the particular partial image set is dried or hardened at least partially between the ink transfer steps, high print quality can be obtained according to the present invention in a simple manner. Since the transferred partial image set is dried or hardened at least partially, no ink is transferred from the surface back onto the rubber blanket cylinder any more. An ink other than the ink intended is thus prevented from being transferred back into inking mechanisms. In addition, it was possible to observe that the wet partial image to be transferred showed a smaller dot increase because of the partial drying of the partial image set.

Since the second partial image or the following partial images is/are transferred onto an at least partially dried or partially hardened partial image, the print quality as a whole can be increased, because the running into one another of partial images of different colors can thus be effectively ruled out. In addition, the ink transfer properties on an at least partially dried surface can be better controlled, so that it is possible to print especially total images rich in contrast in a simple manner according to the present invention, since the second and subsequent partial images are transferred to at an least partially dried or at least partially hardened partial image with defined surface properties that can be preset in a simple manner (e.g., by selecting the drying conditions).

Furthermore, it is advantageous that the drying as a whole can be carried out more gently and more uniformly because the drying process is distributed among a plurality of individual steps, between which a repeated image transfer takes place. Excessive exposure to heat of the material of the body to be printed on can be avoided by selecting suitable drying parameters.

The first partial image is preferably a monochrome partial image, which consequently consists of only one color and does not already comprise partial images superimposed to one another itself. The second partial image to be transferred and each following partial image to be transferred may be monochrome or may be composed of a plurality of varicolored partial images superimposed to one another. The process according to the present invention is characterized by an advantageously high variability, because the composition of the partial images to be transferred can be adapted to the print production according to the present invention in a simple manner. For example, the total number of partial images from which the second partial image to be transferred or a partial image to be transferred next is composed can be changed without any further changes in the design of the printing device. Since the second partial image to be transferred or the partial images to be transferred subsequently is/are always transferred onto a set partial image with defined surface properties, high print quality can always be achieved.

A partial image transferred onto the surface is dried or hardened at least partially according to the present invention. The surface layer of the transferred partial image that is responsible for the surface properties of the transferred partial image is consequently hardened or at least partially hardened and offers a defined surface for a subsequent ink transfer operation. Another parameter, which can be varied in a simple manner, and with which the print quality that can be achieved can be further optimized, is available in the printing process according to the present invention with the duration and intensity of the drying step.

The drying step is carried out according to the present invention in the ink transfer position, i.e., the printed surface is moved only insignificantly if at all from the ink transfer position for drying during the multicolor printing. The surface to be printed on is preferably mounted rotatably and rolls on the rubber blanket cylinder with the partial image to be transferred, which is located on it, during each ink transfer. The partial images on the rubber blanket cylinder are registered for the rotary movement of the surface to be printed on. The drying or initial hardening of a transferred partial image is preferably performed now on the surface in a position of the path, on which the surface is led between the individual ink transfer operations, which position is located directly downstream of the ink transfer position, e.g., opposite that position. In principle, the drying or initial hardening may, however, also take place exactly at the ink transfer position or in the immediate vicinity thereof, e.g., by irradiation or the admission of heat from a rear side of the surface to be printed on.

All partial images to be transferred are preferably transferred to the same rubber blanket cylinder, at which the surface to be printed on rolls synchronously with the circumferential movement of the rubber blanket cylinder. It is advantageous that a multicolor printing device of a relatively simple design requiring little maintenance can thus be obtained.

An especially preferred application pertains to the multicolor printing on cylindrical, conical or comparably shaped containers, e.g., tubs, cans or glasses. Such a body is preferably mounted rotatably movably around its longitudinal axis, so that the body can be rolled in the ink transfer position at the rubber blanket cylinder for the ink transfer. The body simply needs only to be rotated further by 360° for a subsequent ink transfer operation. An advantageously large angle range, in which a drying device can be arranged, is available for the intermediate drying or initial hardening step. The drying device is preferably arranged essentially offset by about 180° from the ink transfer position. The drying device may also span a larger angle range in order to achieve a gentle partial drying of a transferred partial image, e.g., by means of a large-area discharge opening of a drying device operating with warm air and/or radiation.

In a preferred multicolor printing device according to the present invention, a plurality of bodies to be printed on are held in a moving mechanism, which is designed to move a plurality of bodies sequentially past the ink transfer position. For printing on cylindrical or comparable bodies, the body is preferably mounted in a rotatably movable manner on a mandrel or a comparable rotatable mount, so that the body can roll at the rubber blanket cylinder for each ink transfer. The moving mechanism is preferably endless, e.g., it is designed as an endless belt or rotary revolver, where bodies to be printed on are introduced into the mechanism at an entry position, and printed-on bodies are removed from the mechanism in an unloading position.

To dry a transferred partial image at the ink transfer position, a drying device is preferably arranged in the immediate vicinity of the ink transfer position. The drying is preferably accelerated by the admission of heat and/or irradiation, especially UV irradiation. The admission of heat and/or irradiation may be directed toward the surface of the body and/or it may take place from the rear side of the said body.

The drying device is preferably arranged on a side of a rotatable mount, e.g., a mandrel, for the body, which side is located opposite the ink transfer position, so that the body is alternatingly printed on at the ink transfer position during the performance of the rotary movement and is dried at least partially at the drying position located opposite the ink transfer position. The drying device may, in principle, also be arranged within the rotatable mount for the body to be printed on in order to admit heat and/or radiation to the printed-on surface from the rear side.

According to a preferred embodiment, the printed-on surface is dried at least partially at the drying position located directly opposite the ink transfer position by irradiation with light in the visible, infrared or preferably ultraviolet range. The drying device preferably comprises for this purpose a radiation source, especially an IR or UV light source, which is arranged in a reflector array surrounding the light source. The reflector array has an opening, which opens toward the drying position and from which the radiation can exit. An air flow, which may be discharged, in principle, from the aforementioned discharge opening and sweep over the printed-on surface, or is guided axially through the drying device to enter and exit at the front sides of the drying device, may flow through the drying device for removing heat.

Thermoplastic inks, which liquefy during heating above a softening or liquefaction point and are transferred in the liquid or softened state onto the surface to be printed on, are used for forming the partial image according to another preferred embodiment. The holding means for holding the surface to be printed on is preferably coolable, so that the transferred partial image can be cooled rapidly and overheating of the surface to be printed on can at the same time be effectively prevented from occurring. As an alternative or in addition, the printed-on surface may be cooled with a cooled gas flow, e.g., on the side of the rotatable mount or support mandrel located opposite the ink transfer position. A blower, a blowing chamber or the like for admitting a cooled gas flow to the printed-on surface is provided for this purpose on the side of the rotatable mount or the support mandrel for holding the body with the surface to be printed on, which side is located opposite the ink transfer position.

The multicolor printing device according to the present invention preferably has an additional drying device, which is arranged in a position located downstream of the ink transfer position, in order to perform the final drying of the total image composed of a plurality of transferred partial images on the surface. It is advantageous that another body can already be printed on during the final drying, so that the throughput of the printing device can be increased.

Figure 2:
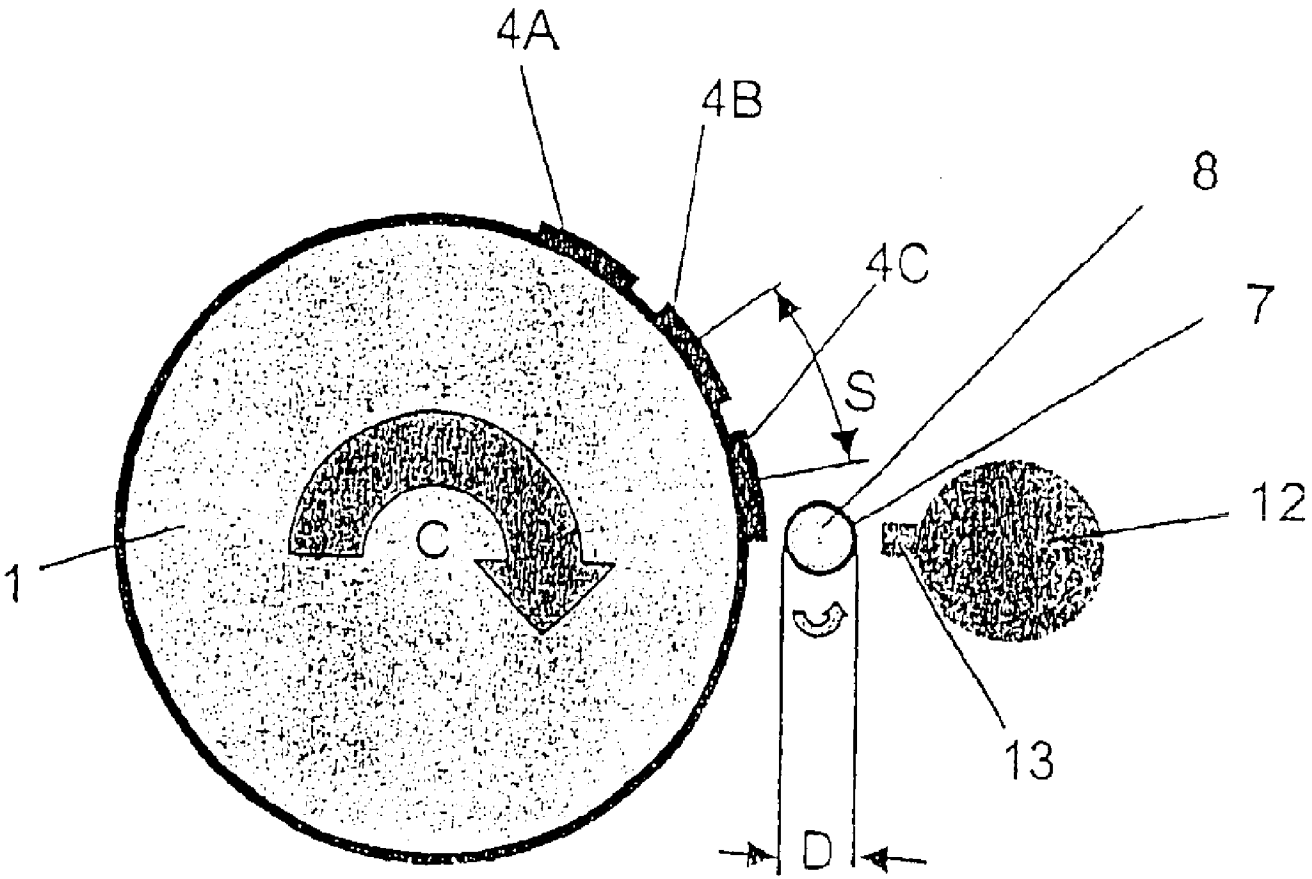
Figure 3:
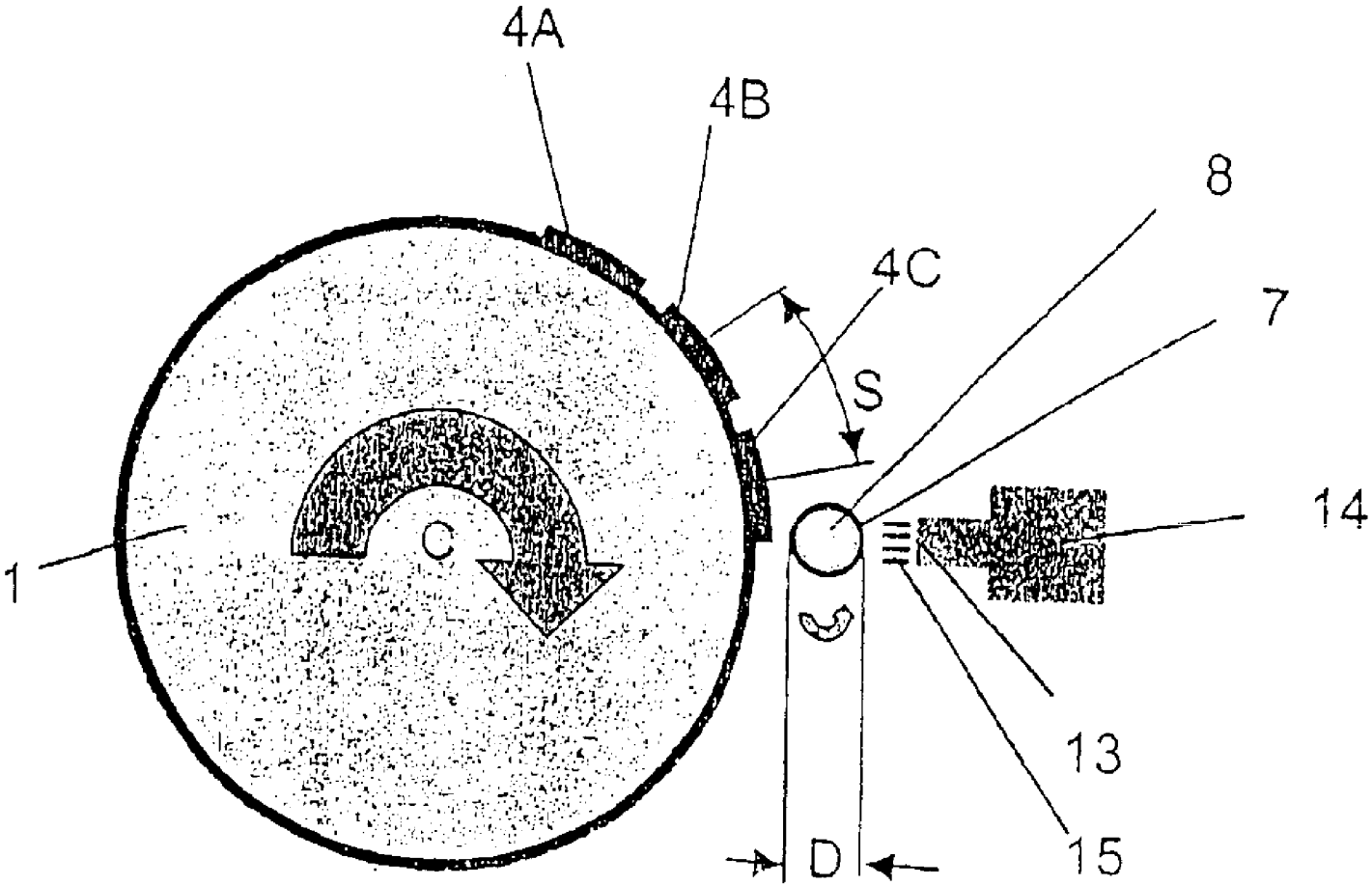

Preferred embodiments of the present invention will be described below as examples and with reference to the attached drawings, in which FIG. 1 schematically shows a cross-sectional view of a printing device according to the present invention;

FIG. 2 schematically shows an enlarged view of the ink transfer position and a drying device arranged at the ink transfer position; and FIG. 3 schematically shows an enlarged view of the ink transfer position and a drying device arranged at the ink transfer position according to another embodiment of the present invention.

Identical reference numbers in the figures designate identical elements or assembly units or elements or assembly units with identical action. FIG. 1 shows a schematic cross-sectional view of a multicolor printing device according to the present invention. The printing device comprises a rubber blanket cylinder 1, around the outer circumference of which a plurality of inking mechanisms 3, of which only two inking mechanisms 3C, 3D are shown in cross section for clarity's sake, are arranged at spaced locations from one another. Partial images to be transferred are inked on the plate cylinder 2A–F by means of the inking mechanisms having a usual design, and they are transferred from there to the outer circumferential surface of the rubber blanket cylinder 1. A plurality of partial images 4A–C are thus formed sequentially and at spaced locations from one another on the outer circumferential surface of the rubber blanket cylinder 1. The partial images to be transferred may be monochrome. A second partial image and partial images 4B, 4A to be transferred thereafter may also be multicolored, i.e., consist of a plurality of partial images, which are superimposed wet in wet and shall be transferred to the body 7 to be printed on in a single ink transfer step.

The printing device comprises, moreover, a moving mechanism 9 to transport a plurality of bodies 7 to be printed on sequentially to the ink transfer position 5. According to FIG. 1, the moving mechanism is designed as a rotary revolver. However, the moving mechanism 9 is not limited to a rotary revolver rotating in a circularly symmetrical manner, but it may also be led endlessly in another manner or may be essentially linear. The moving mechanism 9 comprises an entry position, not shown, in which the bodies 7 to be printed on are introduced into the moving mechanism 9, as well as an unloading position, not shown, where printed-on bodies 7 are again removed from the moving mechanism 9.

In FIG. 1, the rotary revolver 9 rotates counterclockwise. According to FIG. 1, the moving mechanism 9 is designed for printing on cylindrical, conical or comparably shaped, e.g., slender bodies. The rotary revolver 9 comprises for this purpose a plurality of rotatable mounts 8 for the bodies 7 to be printed on. In FIG. 1, each body 7 is placed on a support mandrel 8, which can be driven by means of a rotating drive, not shown. The velocity of the rotating drive is selected such that the surface to be printed on is rolled synchronously with the circumferential velocity of the outer circumferential surface of the rubber blanket cylinder 1 at the rubber blanket cylinder at the ink transfer position 5.

A drying device 10 is arranged at the ink transfer position 5 in order to dry a partial image transferred onto the body 7 to be printed on on the side of the support mandrel 8 located opposite the ink transfer position 5. The body 7 to be printed on is thus rotated several times by means of the support mandrel 8 at the ink transfer position 5, and a drying step takes place between each ink transfer operation at or in the immediate vicinity of the ink transfer position 5.

After the transfer of the intended number of partial images to the body 7, the rotary revolver 9 is turned further counterclockwise to the drying position 6 located downstream of the ink transfer position 5, where another drying device 10' is provided to dry the total image transferred onto the body 7.

Thus, a multicolor printing process according to the present invention comprises the following steps: A first partial image 4C is transferred to a rubber blanket cylinder 1. At least one additional partial image 4B is subsequently transferred to the outer circumference of the rubber blanket cylinder 1. The second partial image and each additional transferred partial image may be monochrome or comprise a plurality of preferably varicolored partial images, which are superimposed to one another. The partial images 4A–C on the rubber blanket cylinder 1 are offset in relation to one another. The circumferential distance between the partial images 4A–C is preferably selected to be such that it corresponds to the outer circumference or a multiple integer of the said outer circumference of the body 7 to be printed on, so that the support mandrel 8 is rotated synchronously with the speed of rotation of the rubber blanket cylinder 1 for the transfer of the partial image in good register.

A body 7 to be printed on is moved to the ink transfer position 5 by means of the moving mechanism 9. To transfer the first partial image 4C, the body 7 seated on the support mandrel 8 rolls on the outer circumference of the rubber blanket cylinder 1 and takes up the first partial image 4C in the process. During the further rotation of the body 7, the said body is moved past the drying device 10, where the first partial image 4C is dried at least partially. The rubber blanket cylinder 1 rotates further at the same time in order to transport the next partial image 4B transferred to the ink transfer position 5. During the further rotation of the body 7, the first partial image 4C, which was transferred to the body 7 and was dried at least partially, will again reach the ink transfer position 5, where the superimposition of the partial images 4B, 4C will subsequently take place in good register. This operation, which comprises alternatingly ink transfer steps and drying steps, is repeated until the last partial image 4A of the partial images to be transferred has been transferred to be body 7.

The body 7 is then transferred by means of the moving mechanism 9 to the drying position 6 arranged downstream of the ink transfer position 5, where the final drying of the total image takes place. The printed-on body 7 is finally removed from the moving mechanism 9 at an unloading position, not shown.

More layers, e.g., a transparent coat, may, of course, be transferred to the total image to increase the gloss or to form additional barrier properties. Such additional layers may likewise by transferred to the body 7 by means of the rubber blanket cylinder 1 or with an additional printing device, not shown, which is arranged between the ink transfer position 5 and the drying position 6 or downstream of the drying position 6.

The drying of the partial image and/or the total image is preferably carried out by means of a contactless energy source, which operates with the admission of beat and/or irradiation, especially in the visible, infrared or ultraviolet spectral range. Suitable drying devices are known to the person skilled in the art in this area.

The drying device 10, 10' schematically shown in FIG. 1 comprises a light source 11 operating in the desired spectal range, which is arranged in a reflector array 12 surrounding the light source 11. The reflector array 12 is opened at least in the area of an outlet opening 13, from which the radiation and/or the air flow exits from the drying device 10, 10' in order to reach the printed-on surface of the body 7.

The reflector array 12 is preferably designed at least in some sections as a concave mirror, e.g., as a spherical concave mirror or a paraboloid concave mirror in order to reflect the radiation emitted by the light source 11 on the printed-on surface. The light source 11 may be arranged to this end in the focal point of the concave mirror, so that the radiation exits the outlet opening 13 of the drying device 10, 10' essentially as a parallel ray beam.

To remove heat, an air flow may flow through the reflector array 12, which air flow is led, e.g., axially, i.e., essentially in parallel to the longitudinal axis of the body 7 to be dried and enters and leaves on the front sides of the drying device 10, 10', or exits from the outlet opening 13, to sweep over the surface of the body 7 to be dried, in order to additionally accelerate the drying operation.

Although not shown in the figures, the drying may also take place from the rear side of the surface to be dried, especially by the admission of heat and/or irradiation from the rear side of the body 7. A drying device, e.g., a radiation source, may be provided for this purpose in each support mandrel 8. The support mandrel may be cooled (see below) in case of the of hot melt inks.

FIG. 2 shows an enlarged perspective cross section of the elements arranged in the vicinity of an ink transfer position 5. The outlet opening 13 of the reflector array 12 has a nozzle-like design and faces a side of the support mandrel 8 that faces away from the ink transfer position proper. The ink transfer and the drying of the ink thus take place alternatingly in essentially opposite angular positions of the support mandrel 8. The support mandrel 8 has a diameter D, so that the distance between two consecutive partial images 4B, 4C on the outer circumferential surface of the rubber blanket cylinder 1 corresponds to the outer circumference of the body 7 to be printed on, which can be calculated from D, or to an integer multiple thereof.

The support mandrel 8 may be cooled in the above-described embodiments, e.g., a cooled gas flow or a cooling liquid may flow through it to effectively prevent the body to be printed on from overheating.

The process according to the present invention may also be applied readily to inks other than those to be applied in the liquid or pasty form to form the partial images. This is illustrated on the basis of FIG. 3, which schematically shows another embodiment of the present invention, in which the so-called hot melt inks are used. These types of thermoplastic inks are based on a high fat content, which may reach up to 100%, and which are liquefied or softened by heating, e.g., to about 150° C.–180° C., so that the partial images thus liquefied or softened can be transferred to the bodies 7 to be printed on in the above-described manner. The hot melt ink transferred to the body 7 cools rapidly and hardens in the process in order to form an at least partially dried partial image. This cooling may be advantageously supported by additional measures.

To harden hot melt inks, the support mandrel shown in FIG. 3 may be precooled in the known manner, e.g., by a cooled gas flow or a cooling liquid, so that the round body 7 placed on the support mandrel 8 is also cooled on its way to the ink transfer position 5. The pasty hot melt-like printing ink begins to solidify immediately on the round body 7 during the transfer of the first partial image 4C.

The cooling of the transferred partial image may also be supported by admitting a cooled gaseous flow 15, e.g., cooled air, to, the surface of the body 7. As is shown in FIG. 3, a blower 14 is provided for this purpose. The blower 14 may be designed as a blow box, with a housing wall and a discharge opening 13 in order to direct the cooled gas flow toward the printed surface of the round body 7 in a directed manner. The blower is preferably arranged on the side of the support mandrel 8 located opposite the ink transfer position.

The transferred partial image is thus cooled and sufficiently hardened on the side of the support mandrel 8 located opposite the ink transfer position 5. The subsequent transfer of the partial images 4B and 4A takes place analogously to the solidified or at least partially dried surface of the round body 7.

A preferred application pertains to the multicolor printing on cylindrical, conical or comparably shaped slender bodies, e.g., tubes, cans, glasses and the like, especially preferably bodies made of plastics, especially transparent plastics. A monochrome color image or even a bonding agent (primer) may be set with the first partial image and dried at least partially before an ink application proper, without an additional application station or a separate run through the press being necessary for this.

A machine-readable bar code is especially preferably printed with the process according to the present invention, for which purpose a preferably white ink field is set first, and the bar code is printed on it.

Especially in the case of transparent bodies, the first partial image may also ensure only a monochrome color background, on which at least one additional partial image or preferably a multicolor total image is printed after partial drying. It is possible according to the present invention to apply an intensely pigmented, thick overall ink layer by means of dry two-layer or more than two-layer ink layers applied in advance.

The process according to the present invention is, of course, also suitable for printing on any other surfaces, e.g., of labels, signs and/or any bodies, containers or the like.

What is claimed is:

1. A process for printing a multicolor image, which is composed of two varicolored partial images on a workpiece surface, the process comprising the steps of:

transferring a first partial image onto the workpiece surface at an ink transfer position;

transferring a second partial image to the workpiece surface at the same ink transfer position, said transferring of the second partial image superimposing the second partial image onto the first partial image;

one of drying and hardening the transferred partial images at the ink transfer position.

2. A process in accordance with claim 1, further comprising:

providing a rubber blanket cylinder;

applying the first and second images to the rubber blanket cylinder.

3. A process in accordance with claim 2, wherein:

said partial images are applied in circumferential positions of the rubber blanket cylinder and said partial images are offset in relation to one another.

4. A process in accordance with claim 2, wherein:

the workpiece surface is moved past the ink transfer position synchronously with a circumferential movement of the rubber blanket cylinder for said transferring of the partial images.

5. A process in accordance with claim 1, wherein:

the workpiece surface is arranged on an outer circumference of a body;

the body is mounted rotatably movably around a longitudinal axis and is rotated around its longitudinal axis each time for said transferring of the partial images at the ink transfer position.

6. A process in accordance with claim 5, wherein:

the workpiece surface is rotated at the ink transfer position for said drying or hardening between said two transferring steps.

7. A process in accordance with claim 5 wherein:

the partial images are formed by liquefying thermoplastic color images;

the mounted body is cooled and/or a cooled gas flow is blown onto the workpiece surface between said two transferring steps.

8. A process in accordance with claim 5, further comprising:

providing a plurality of bodies with workpiece surfaces;

holding the plurality of bodies in a rotary revolver;

transporting the bodies in the rotary revolver to the ink transfer position;

drying or hardening the multicolor image composed of a plurality of transferred partial images in a position arranged downstream of the ink transfer position in a final drying step.

9. A process in accordance with claim 1, wherein:

the first partial image is a monochrome image, especially with uniform color intensity;

the second partial image is one of a monochrome partial image, a partial image composed of a plurality of varicolored partial images, and a bar code.

10. A device for printing a varicolored image, which is composed of at least two said varicolored partial images on a workpiece surface, the device comprising:

an ink transfer mechanism to transfer a first partial image to the workpiece surface in an ink transfer position and to transfer a second partial image to the workpiece surface in the same said ink transfer position, said ink transfer mechanism superimposing the second partial image onto the first partial image, and a drying device to dry or harden the transferred partial images, said drying device being arranged at said ink transfer position.

11. A device in accordance with claim 10, wherein:

said ink transfer mechanism includes a rubber blanket cylinder onto which all the partial images are transferred.

12. A device in accordance with claim 11, further comprising:

a control device to apply the partial images in circumferential positions of said rubber blanket cylinder, said circumferential positions being offset in relation to one another in good register.

13. A device in accordance with one of the claim 11, further comprising:

a carrying device to carry the workpiece surface and to move the workpiece surface past said ink transfer position synchronously with a circumferential movement of said rubber blanket cylinder for image transfer.

14. A device in accordance with one of the claim 13, wherein:

said carrying device includes a mandrel mounted rotatably movably around its longitudinal axis for holding a body having the workpiece surface, wherein the body is rotated around its longitudinal axis in said ink transfer position for transferring the images.

15. A device in accordance with claim 13, wherein:

said drying device is arranged on a side of said carrying device located opposite said ink transfer position;

said carrying device is designed to rotate the workpiece surface from said ink transfer position to said drying device for drying or partial hardening between two image transfer steps.

16. A device in accordance with claim 14, wherein:

said carrying device is coolable and/or a blowing device is provided between two image transfer steps for drying a partial image to blow a cooled gas flow onto the workpiece surface in order to cool partial images formed by liquefaction of thermoplastic color images.

17. A device in accordance with claim 10, wherein:

said drying device comprises a light source especially a UV light source.

18. A device in accordance with claim 17, wherein:

said light source comprises a reflector with an outlet opening to reflect light emitted by said light source through said outlet opening on the partial image to be dried.

19. A device in accordance with claim 18, wherein:

said light source of said drying device is cooled by an air flow, which is discharged through said outlet opening to sweep over the partial image to be dried, or is led axially past said light source, and enters and leaves on sides of said drying device.

20. A device in accordance with claim 10, further comprising:

a rotary revolver holding a plurality of bodies, each of the bodies having a workpiece surface, said rotary revolver transporting the bodies to position;

an additional drying device is provided in a position arranged downstream of said ink transfer position to dry the multicolor image composed of a plurality of transferred partial images in a downstream drying position in a final drying step.

21. A device in accordance with claim 10, wherein:

the first partial image is a monochrome image, especially with uniform color intensity;

the second partial image is one of a monochrome partial image, a partial image composed of a plurality of varicolored partial images, and a bar code.

22. A process for printing a plurality of images on a workpiece surface, the process comprising the steps of:

moving the workpiece surface to an ink transfer position;

transferring a first image of the plurality of images to the workpiece surface at the ink transfer position;

curing the first image on the workpiece surface at the ink transfer position;

superimposing at the ink transfer position, a second of the plurality of images onto the first image on the workpiece surface.

23. A process in accordance with claim 22, further comprising:

curing the second image on the workpiece surface at the ink transfer position.

24. A process in accordance with claim 22, wherein:

said superimposing of the second image is performed after said curing of the first image.

* * * * *